US011178904B2

(12) United States Patent
Milandri et al.

(10) Patent No.: US 11,178,904 B2
(45) Date of Patent: Nov. 23, 2021

(54) FILLING UNIT FOR A MANUFACTURING MACHINE FOR THE PRODUCTION OF DISPOSABLE CARTRIDGES FOR ELECTRONIC CIGARETTES

(71) Applicant: G.D SOCIETA' PER AZIONI, Bologna (IT)

(72) Inventors: Francesco Milandri, Cesena (IT); Fabrizio Ronzani, Bologna (IT); Simone Scagliarini, San Giovanni in Persiceto (IT); Michele Squarzoni, Ferrara (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 16/636,054

(22) PCT Filed: Aug. 8, 2018

(86) PCT No.: PCT/IB2018/055962
§ 371 (c)(1),
(2) Date: Feb. 3, 2020

(87) PCT Pub. No.: WO2019/030685
PCT Pub. Date: Feb. 14, 2019

(65) Prior Publication Data

US 2021/0161198 A1 Jun. 3, 2021

(30) Foreign Application Priority Data

Aug. 8, 2017 (IT) ..... 102017000091504

(51) Int. Cl.
*A24C 5/39* (2006.01)
*A24F 40/70* (2020.01)
(Continued)

(52) U.S. Cl.
CPC ..... *A24C 5/397* (2013.01); *A24F 40/70* (2020.01); *B65B 1/363* (2013.01); *B65B 37/20* (2013.01); *B65B 1/24* (2013.01)

(58) Field of Classification Search
CPC ..... A24C 5/397; B65B 37/20; B65B 1/363; B65B 1/24; B65B 3/06; B65B 3/28; B65B 7/28; A24F 40/70
(Continued)

(56) References Cited

U.S. PATENT DOCUMENTS 2,928,438 A * 3/1960 La Pier ..... B65B 1/363 141/150
3,187,958 A * 6/1965 Swart ..... B65D 88/66 222/227
(Continued)

FOREIGN PATENT DOCUMENTS

WO WO-2017/051348 A1 3/2017
WO WO-2017/051349 A1 3/2017
WO WO-2017/051350 A2 3/2017

OTHER PUBLICATIONS

International Application No. PCT/IB2018/055962, International Search Report and Written Opinion, dated Nov. 7, 2018.

*Primary Examiner* — Timothy L Maust
*Assistant Examiner* — James R Hakomaki
(74) *Attorney, Agent, or Firm* — Marshall, Gerstein & Borun LLP

(57) ABSTRACT

Filling unit for a manufacturing machine for the production of disposable cartridges for electronic cigarettes; the filling unit has: a cylindrical tank which is arranged horizontally, is mounted so as to rotate in a stepwise manner around a vertical rotation axis, is delimited, at the bottom, by a base disc having a circular shape, and is delimited, on the sides, by a cylindrical side wall; a feeding duct that feeds a flow of tobacco inside the tank; a plurality of groups of seats, each
(Continued)

of which is obtained in the base disc and is adapted to receive and contain a corresponding dose of tobacco; and a transfer device which is arranged in a fixed position and cyclically transfers the doses of tobacco contained inside the seats of a group standing still.

3 Claims, 9 Drawing Sheets

(51) Int. Cl.
*B65B 1/36* (2006.01)
*B65B 37/20* (2006.01)
*B65B 1/24* (2006.01)

(58) Field of Classification Search
USPC ..... 141/129
See application file for complete search history.

(56) References Cited

U.S. PATENT DOCUMENTS 3,201,001 A * 8/1965 Roberts ..... G01F 11/24 406/63
3,554,412 A 1/1971 Hayashi et al.
3,555,605 A * 1/1971 Angelotti ..... B30B 11/022 425/155
4,030,205 A * 6/1977 Robertson ..... B29B 13/065 34/380
4,073,244 A * 2/1978 Snowdon ..... B65G 53/12 241/235
4,177,941 A * 12/1979 Leong ..... G01F 11/24 222/636
4,192,359 A * 3/1980 Pippin ..... B65B 43/60 141/12
4,652,342 A * 3/1987 Kuerston ..... C10B 1/04 201/33
4,789,559 A * 12/1988 Hirao ..... C07H 15/04 426/3
4,821,782 A * 4/1989 Hyer ..... B65B 37/00 141/255
5,320,146 A * 6/1994 Stevie ..... B65B 1/363 141/1
5,791,127 A * 8/1998 Rossi ..... B65B 1/363 53/559
6,098,675 A * 8/2000 Runft ..... B65B 1/363 141/81
6,425,422 B1 * 7/2002 Trebbi ..... A61J 3/074 141/67
7,665,932 B2 * 2/2010 Scharger ..... B65G 53/4616 406/128
2005/0118260 A1 6/2005 Bailey et al.
2015/0158614 A1 * 6/2015 Malick ..... B65B 1/04 53/468
2016/0183595 A1 * 6/2016 Grimandi ..... A24F 40/70 29/428
2018/0179042 A1 * 6/2018 Garthhaffner ..... B65B 37/20
2019/0029922 A1 * 1/2019 Tagliavini ..... A61J 3/074
2019/0124992 A1 * 5/2019 Nakano ..... A61M 15/06
2020/0156811 A1 * 5/2020 Milandri ..... B65B 1/363

* cited by examiner

FILLING UNIT FOR A MANUFACTURING MACHINE FOR THE PRODUCTION OF DISPOSABLE CARTRIDGES FOR ELECTRONIC CIGARETTES

CROSS-REFERENCE TO RELATED APPLICATIONS

This is the U.S. national phase of International Application No. PCT/162018/055962, filed Aug. 8, 2018, which claims the benefit of Italian Patent Application No. 102017000091504, filed Aug. 8, 2017.

TECHNICAL FIELD

The present invention relates to a filling unit for a manufacturing machine for the production of disposable cartridges for electronic cigarettes.

PRIOR ART

Recently, single use (i.e. disposable) cartridges have been proposed for electronic cigarettes comprising a casing made of a plastic material having a tubular shape with a micro-perforated bottom wall and a quantity of tobacco powder is contained there, surmounted by a pad made of filtering material; the casing is closed at an upper end (i.e. opposite the micro-perforated bottom wall) by means of a sealing ring which is welded to the casing itself.

The production of said cartridges provides for filling each casing with a calibrated dose of tobacco powder, slightly compressing the dose of tobacco powder inside the casing so as to obtain the desired density and then capping the casing by applying both the filtering pad and the sealing ring to the open upper end. The cartridges are subsequently individually weighed in order to allow discarding non-compliant ones that hold an insufficient or excessive amount of powdered tobacco on the inside thereof.

Once the production of the cartridges is finished, the latter are inserted into sealed packages, typically blister packages. Patent applications WO2017051348A1, WO2017051349A1 and WO2017051350A1 provide an example of a filling unit for a manufacturing machine for the production of disposable cartridges for electronic cigarettes of the type described above. This filling unit is able to operate efficiently (i.e. with a high hourly production, in terms of the number of cartridges produced in the time unit) and effectively (i.e. with a small number of discarded pieces and with a high final quality); however, electronic cigarettes that use the above-described cartridge are experiencing considerable market success and therefore the manufacturers of the above-described cartridges require a manufacturing machine (and therefore a corresponding filling unit) even more performing, i.e. with a greater hourly production rate, relative to the known manufacturing machine described in patent applications WO2017051348A1, WO2017051349A1 and WO2017051350A1.

DESCRIPTION OF THE INVENTION

The object of the present invention is to provide a filling unit for a manufacturing machine for the production of disposable cartridges for electronic cigarettes, which filling unit allows to achieve high productivity while ensuring high quality standards and, at the same time, being easy and inexpensive to produce.

According to the present invention, a filling unit is provided for a manufacturing machine for the production of disposable cartridges for electronic cigarettes, as claimed in the appended claims.

The claims describe preferred embodiments of the present invention forming an integral part of the present disclosure.

BRIEF DESCRIPTION OF THE DRAWINGS

The present invention will now be described with reference to the attached drawings, which illustrate some non-limiting embodiments thereof, wherein.

PREFERRED EMBODIMENTS OF THE INVENTION

Figure 1:
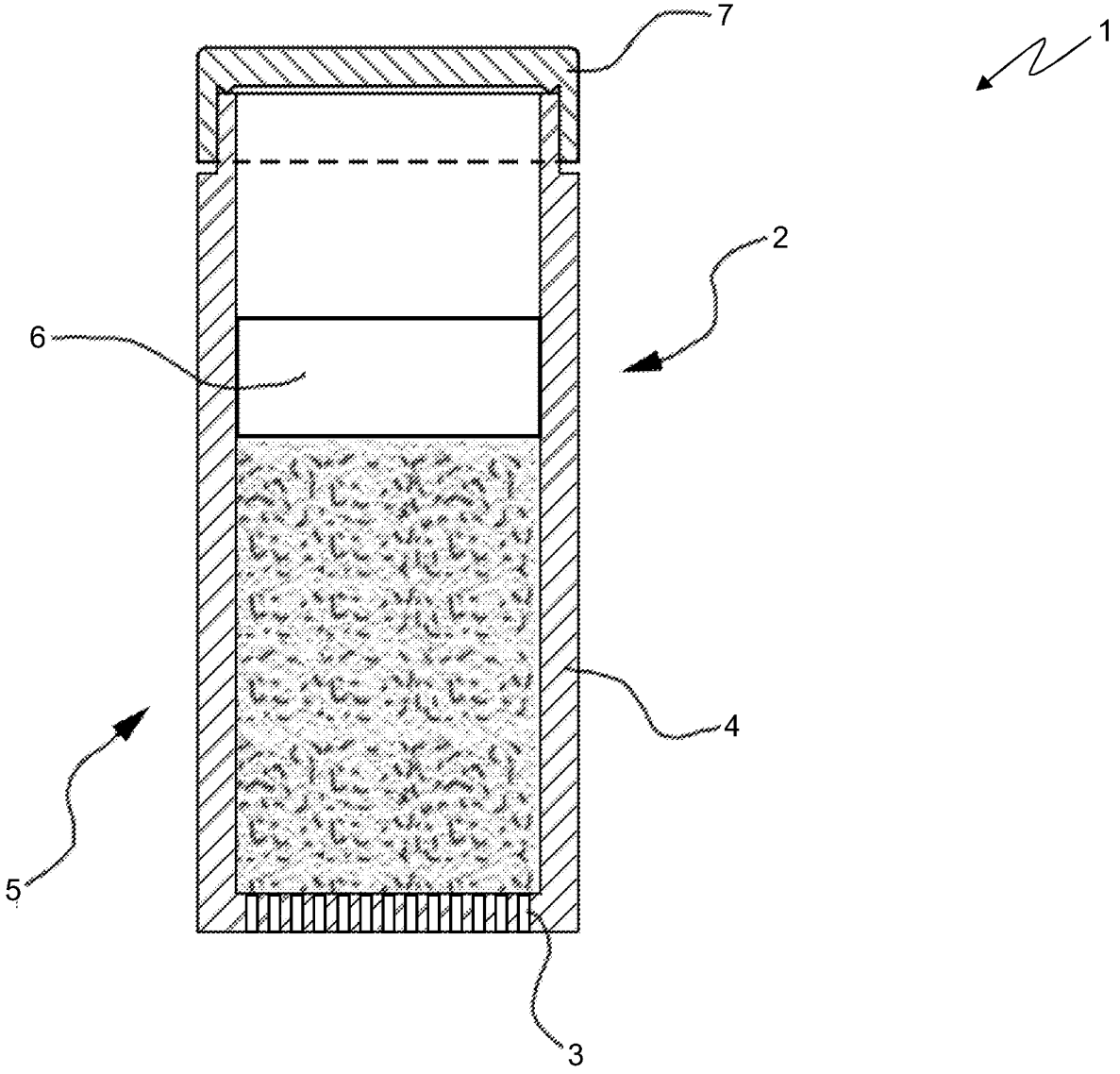
FIG. 1 is a longitudinal section view of a cartridge for electronic cigarette.

In FIG. 1, number 1 denotes as a whole, a disposable cartridge for electronic cigarettes. The disposable cartridge 1 comprises a tubular casing 2 made of a plastic material having a micro-perforated bottom wall 3 and a side wall 4 having a substantially cylindrical shape; inside the tubular casing 2 a dose 5 of powdered tobacco (in contact with the bottom wall 3) is contained, surmounted by a pad 6 of filtering material. Finally, the single-use cartridge 1 comprises a sealing ring 7 (i.e. a sealing washer 7) which is forcibly inserted around an upper end (otherwise completely open) of the tubular casing 2 so as to prevent the filtering pad 6 from escaping; preferably, the sealing ring 7 is welded to the tubular casing 2.

Figure 2:
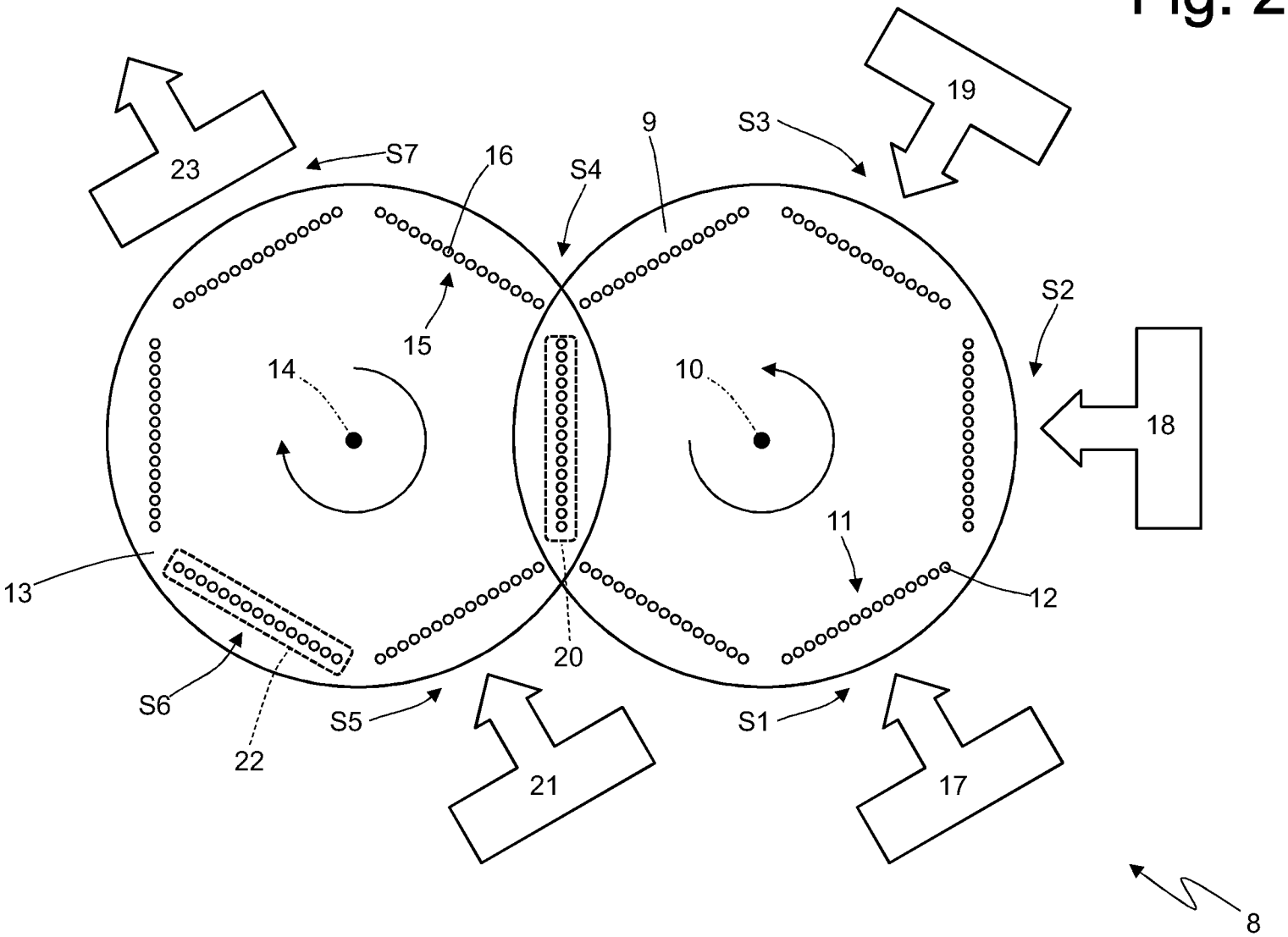
FIG. 2 is a schematic and plan view of a manufacturing machine which produces the cartridge for electronic cigarette of FIG. 1.

In FIG. 2, number 8 denotes as a whole, a manufacturing machine for the production of the disposable cartridges 1 described above. The manufacturing machine 8 shows an intermittent movement, i.e. its conveyors cyclically alternate motion steps and still steps.

As illustrated in FIG. 2, the manufacturing machine 8 comprises a manufacturing drum 9 which is arranged horizontally and is mounted so as to rotate in a stepwise manner around a vertical rotation axis 10; in other words, the manufacturing drum 9 is set into rotation with an intermittent motion, i.e. a non-continuous motion which provides a cyclical alternation of motion steps, wherein the manufacturing drum 9 is moving, and of still steps, wherein the manufacturing drum 9 stops. The manufacturing drum 9 supports six groups 11 of seats 12, each of which is adapted to receive and contain a corresponding tubular casing 2; in particular, each group 11 comprises fifteen seats 12 aligned along a single straight line and the six groups 11 are arranged so as to define, in plan, a regular polygon (i.e. a hexagon) on the surface of the manufacturing drum 9.

The manufacturing machine 8 comprises a further manufacturing drum 13 which is arranged horizontally beside the manufacturing drum 9 and is mounted so as to rotate in a stepwise manner around a vertical rotation axis 14 parallel to the rotation axis 10; in other words, the manufacturing drum 13 is set into rotation with an intermittent motion, i.e. a non-continuous motion which provides a cyclical alternation of motion steps, in which the manufacturing drum 13 is moving, and still steps, wherein the manufacturing drum 13 stops. The manufacturing drum 13 supports six groups 15 of seats 16, each of which is adapted to receive and contain a corresponding tubular casing 2; in particular, each group 15 comprises fifteen seats 16 aligned along a straight line and the six groups 15 are arranged to define, in plan, a regular polygon (i.e. a hexagon) on the surface of the manufacturing drum 13. The manufacturing machine 8 comprises a feeding station S1, in which a feeding unit 17 inserts a corresponding empty tubular casing 2 in each seat 12 of a group 11, which is standing still; in particular, the feeding unit 17 simultaneously inserts fifteen empty tubular casings 2 in as many seats 12 of a group 11 standing still in the feeding station S1. Downstream of the feeding station S1, relative to the rotation direction of the manufacturing drum 9, a filling station S2 is arranged in which a filling unit 18 feeds a corresponding dose 5 of tobacco into each tubular casing 2 carried by a seat 12 of a group 11, standing still; in particular, the filling unit 18 simultaneously feeds fifteen doses 5 of tobacco into as many seats 12 of a group 11 standing still in the feeding station S2. Downstream of the filling station S2, relative to the rotation direction of the manufacturing drum 9, a feeding station S3 is arranged in which a feeding unit 19 feeds a corresponding pad 6 of filtering material into each tubular casing 2 carried by a seat 12 of a group 11, standing still; in particular, the filling unit 19 simultaneously feeds fifteen pads 6 of filtering material in the same number of seats 12 of a group 11 standing still in the feeding station S3.

Downstream of the feeding station S3, relative to the rotation direction of the manufacturing drum 9, a transfer station S4 is arranged in which a transfer unit 20 transfers the tubular casings 2 (each holding a dose 5 of tobacco and a pad 6 of filtering material) from the seats 12 of a group 11 of the manufacturing drum 9 to the seats 16 of a group 15 of the manufacturing drum 13; in particular, the transfer unit 20 simultaneously transfers tubular casings 2 from as many seats 12 of a group 11 standing still in the transfer station S4 to as many seats 16 of a group 15 standing still in the transfer station S4. In the transfer station S4, the two manufacturing drums 9 and 13 are partially overlapped so that the seats 12 of a group 11 of the manufacturing drum 9 are vertically aligned with the seats 16 of a group 15 of the manufacturing drum 13; consequently, in the transfer station S4 the transfer of the tubular casings 2 takes place by means of a linear and vertical movement (i.e. a rise of the casings 2 if the manufacturing drum 9 is arranged under the manufacturing drum 13 or a lowering of the casings 2 if the manufacturing drum 9 is arranged above the manufacturing drum 13).

Downstream of the transfer station S4, relative to the rotation direction of the manufacturing drum 13, a feeding station S5 is arranged in which a feeding unit 21 feeds a corresponding sealing ring 7 into each tubular casing 2 carried by a seat 16 of a group 15, standing still; in particular, the filling unit 21 simultaneously feeds fifteen sealing rings 7 in the same number of seats 16 of a group 15 standing still in the feeding station S5. Downstream of the feeding station S5, relative to the rotation direction of the manufacturing drum 13, a welding station S6 is arranged in which a welding unit 22 performs (preferably by ultrasonic welding) the welding of each sealing ring 7 to the corresponding tubular casing 2 carried by a seat 16 of a group 15, standing still; in particular, the welding unit 22 simultaneously welds fifteen sealing rings 7 to as many tubular casings 2 carried by the seats 16 of a group 15 standing still in the welding station S6. For example, the welding unit 22 is made as described in the patent application IT102016000094855.

In the welding station S6, the manufacturing of the disposable cartridges 1 is completed, i.e. downstream of the welding station S6, the disposable cartridges 1 are finished and ready for use. Downstream of the welding station S6, relative to the rotation direction of the manufacturing drum 13, an output station S7 is arranged in which an output unit 23 extracts a corresponding disposable cartridge 1 from each seat 16 of a group 15, standing still; in particular, the output unit 23 simultaneously extracts fifteen disposable cartridges 1 from as many seats 16 of a group 15 standing still in the output station S7.

From the foregoing it is clear that all the steps of the production process of the disposable cartridges 1 (such as, for example, the filling of the doses 5 of tobacco, the feeding of the pads 6 of filtering material, the feeding of the sealing rings 7, the welding of the sealing rings 7) contained in the seats 12/16 of a same group 11/15 are carried out in parallel, i.e. they are carried out simultaneously for all the disposable cartridges 1 contained in the seats 12/16 of a same group 11/15.

The filling unit 18 is similar, in its general structure, to the filling unit described and illustrated in the patent applications WO2017051348A1, WO2017051349A1 and WO2017051350A1 to which refer for a more detailed description of the filling unit 18.

Figure 3:
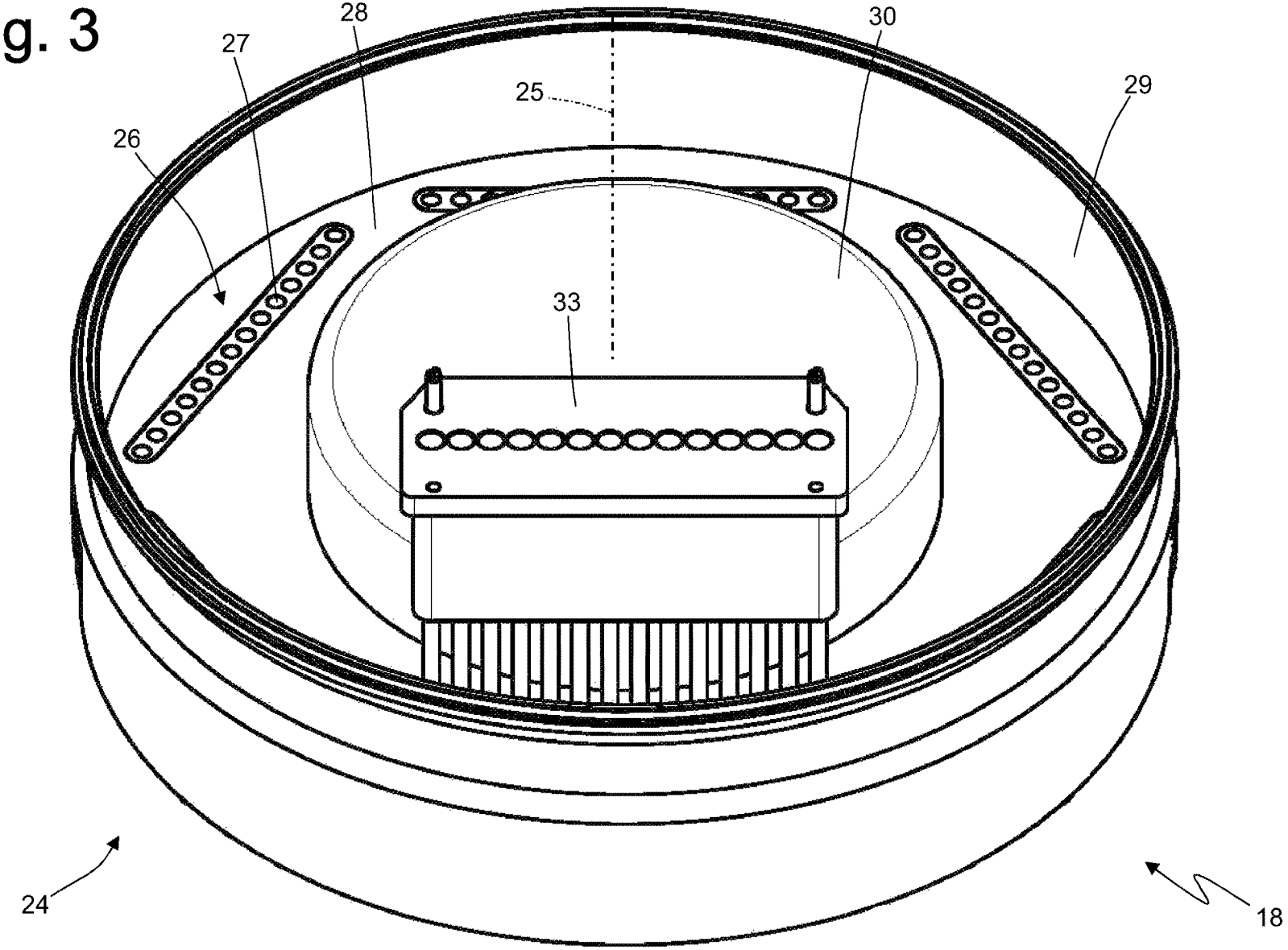
FIG. 3 is a schematic, perspective view and with the different parts removed for clarity, of a tobacco feeding unit of the manufacturing machine of FIG. 2.
Figure 4:
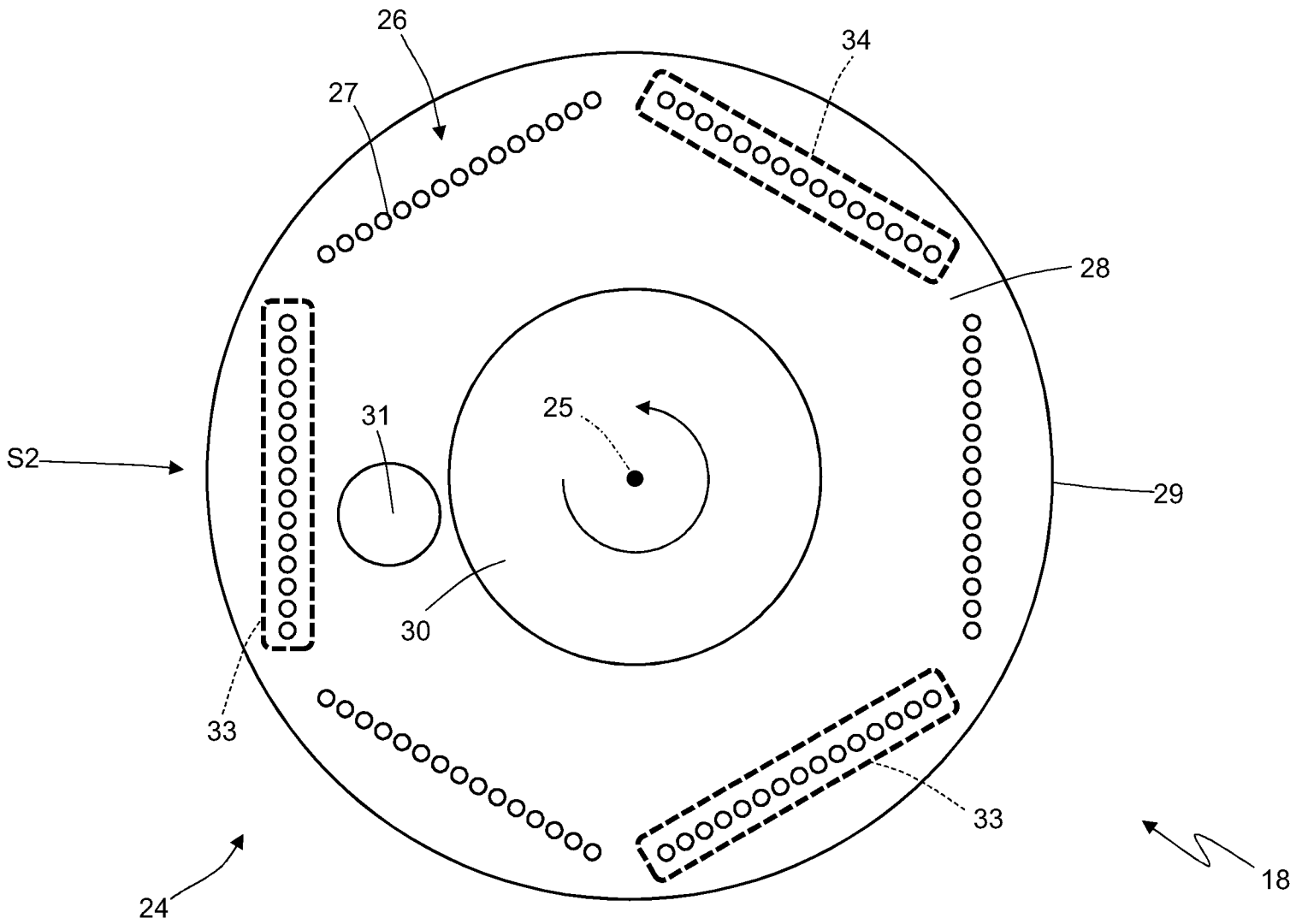
FIG. 4 is a schematic plan view and with different parts removed for clarity, of the tobacco feeding unit of FIG. 3.

As illustrated in FIGS. 3 and 4, the filling unit 18 comprises a cylindrical-shaped tank 24 which is arranged horizontally and is mounted so as to rotate in a stepwise manner around a vertical rotation axis 25 parallel to the rotation axis 10; in other words, the tank 24 is set into rotation with an intermittent motion, i.e. a non-continuous motion which provides a cyclical alternation of motion steps, wherein the tank 24 is moving, and of still steps, wherein the tank 24 stops. The tank 24 is arranged beside the manufacturing drum 9 and partially overlapping the manufacturing drum 9 itself at the filling station S2; in particular, the tank 24 is arranged higher than the manufacturing drum 9 so as to be on top of the manufacturing drum 9 at the filling station S2. The tank 24 supports six groups 26 of seats 27, each of which is adapted to receive and contain a corresponding dose 5 of tobacco; in particular, each group 26 comprises fifteen seats 27 aligned along a straight line and the six groups 26 are arranged to define, in plan, a regular polygon (i.e. a hexagon) on the surface of the annular tank 24.

The tank 24 is delimited, at the bottom, by a base disc 28 having a circular shape and is delimited, on the sides, by a cylindrical side wall 29 which rises perpendicularly from the base disc 28; the seats 27 are obtained in the base disc 28, i.e. they are formed by circular through holes made through the base disc 28. Centrally, from the base disc 28 a central cylindrical-shaped element 30 rises, which gives an annular shape (i.e. a "donut" shape) to the inner volume of the tank 24.

According to what is illustrated in FIG. 4, a cylindrical feeding duct 31 is coupled to the tank 24, which is vertically orientated (at least in its end portion) and has an outlet opening arranged inside the tank 24; the feeding duct 31 continuously feeds a flow of tobacco 32 inside the tank 24 (illustrated in FIGS. 5-8) which forms a bed resting on the base disc 28 of the tank 24.

The filling unit 18 comprises a transfer device 33 which is arranged in a fixed position (i.e. without rotating together with the tank 24) at the filling station S2 and cyclically transfers the doses 5 of tobacco contained in the seats 27 of a group 26 standing still in the filling station S2, in corresponding seats 12 of a group 11 standing still in the filling station S2 of the manufacturing drum 9. In the filling station S2, the tank 24 (i.e. the base disc 28 of the tank 24) is partially overlapping the manufacturing drum 9 so that the seats 27 of a group 26 of the tank 24 are vertically aligned and arranged above the seats 12 of a group 11 of the manufacturing drum 9; consequently, in the filling station S2 the transfer of the doses 5 of tobacco takes place by means of a linear and vertical downward movement (i.e. a descent of the doses 5 of tobacco). The transfer device 33 comprises a plurality of pushers (partially illustrated in FIG. 3), each of which is coupled to a corresponding seat 27 of a group 26 standing still in the filling station S2 and is provided with an alternating vertical motion. As regards the detailed operation of the transfer device 33, reference is made to the patent applications WO2017051348A1, WO2017051349A1 and WO2017051350A1.

The filling unit 18 comprises two twin compression devices 34 and 35 (i.e. structurally completely identical), which are arranged inside the tank 24 in a fixed position (i.e. without rotating together with the tank 24) and in succession (i.e. one after the other) relative to the rotation direction of the tank 24. According to a preferred embodiment illustrated in FIG. 4, the two compression devices 34 and 35 are not contiguous, but between the two compression devices 34 and 35 a given space is provided so as to have a given temporal pause between the two compression operations. As illustrated in FIGS. 5-8, the compression devices 34 and 35 compress the doses 5 of tobacco into the corresponding seats 27 so as to facilitate the complete filling of the seats 27 with a quantity of tobacco 32 (which forms the corresponding dose 5 of tobacco) as uniform and constant as possible.

The compression device 34 comprises a plurality of pushers 36, each of which is coupled to a corresponding seat 27 of a group 26 standing still at the compression device 34 and is provided with an alternating vertical motion; in particular during the rotation of the tank 24 the pushers 36 are spaced apart from the base disc 28 so as not to touch the tobacco 32 whereas, when the tank 28 stops, the pushers 36 perform a compression cycle (i.e. an active downward stroke and a subsequent upward return stroke) for pushing (compressing) the tobacco 32 into the corresponding seats 27 of a group 26 standing still at the compression device 34. According to a preferred, but not limiting, embodiment illustrated in the accompanying figures, the pushers 36 of the compression device 34 partially enter the corresponding seats 27.

The compression device 35 comprises a plurality of pushers 37, each of which is coupled to a corresponding seat 27 of a group 26 standing still at the compression device 35 and is provided with an alternating vertical motion; in particular during the rotation of the tank 24 the pushers 37 are spaced apart from the base disc 28 so as not to touch the tobacco 32 whereas, when the tank 28 stops, the pushers 37 perform a compression cycle (i.e. an active downward stroke and a subsequent upward return stroke) for pushing (compressing) the tobacco 32 into the corresponding seats 27 of a group 26 standing still at the compression device 35. According to a preferred, but not limiting, embodiment illustrated in the accompanying figures, the pushers 37 of the compression device 35 do not enter into the corresponding seats 27, i.e. they stop a little before reaching the corresponding seats 27.

Figure 5:
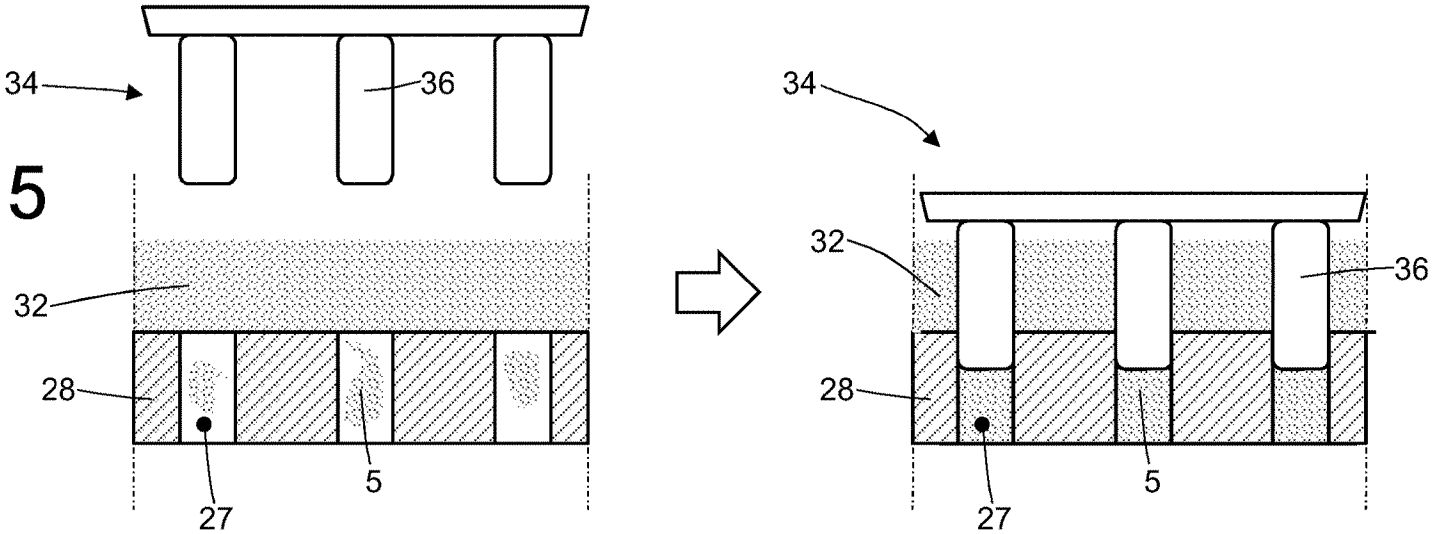
FIGS. 5 and 6 are schematic views of the operation of two compression devices of the tobacco feeding unit of FIG. 3.
Figure 6:
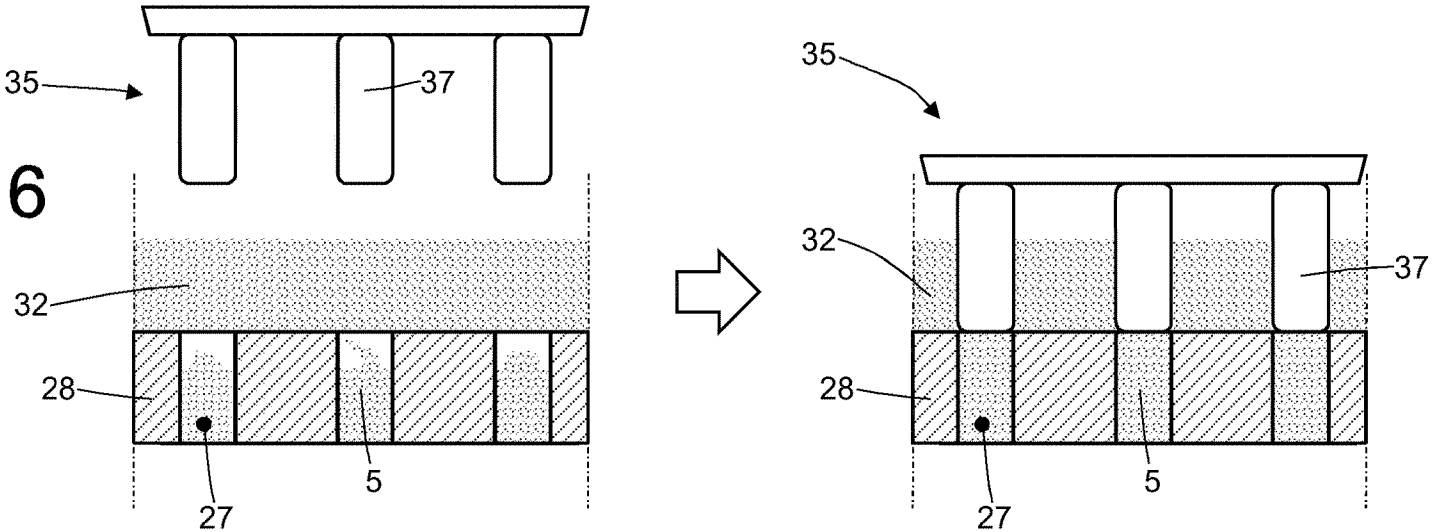

According to the embodiment illustrated in FIGS. 5 and 6, the pushers 36 and 37 of the compression devices 34 and 35 move vertically with a constant length stroke and thus therefore exerting, on the tobacco 32, a variable compression force as a function of how much tobacco 32 remains "trapped" underneath the pushers 36 and 37; it is important to note that the compression force to which the tobacco 32 is subjected, underneath a pusher 36 or 37, is directly proportional to the compression pressure since the area involved is substantially always the same. In the embodiment illustrated in FIGS. 5 and 6, the pushers 36 and 37 of the compression devices 34 and 35 are rigidly connected to corresponding actuators which impress the same constant strokes to the pushers 36 and 37. According to the alternative embodiment illustrated in FIGS. 7 and 8, the pushers 36 and 37 of the compression devices 34 and 35 move vertically with a variable length stroke, thus exerting a constant compression force on the tobacco 32 regardless of how much tobacco 32 remains "trapped" underneath the pushers 36 and 37.

Figure 7:
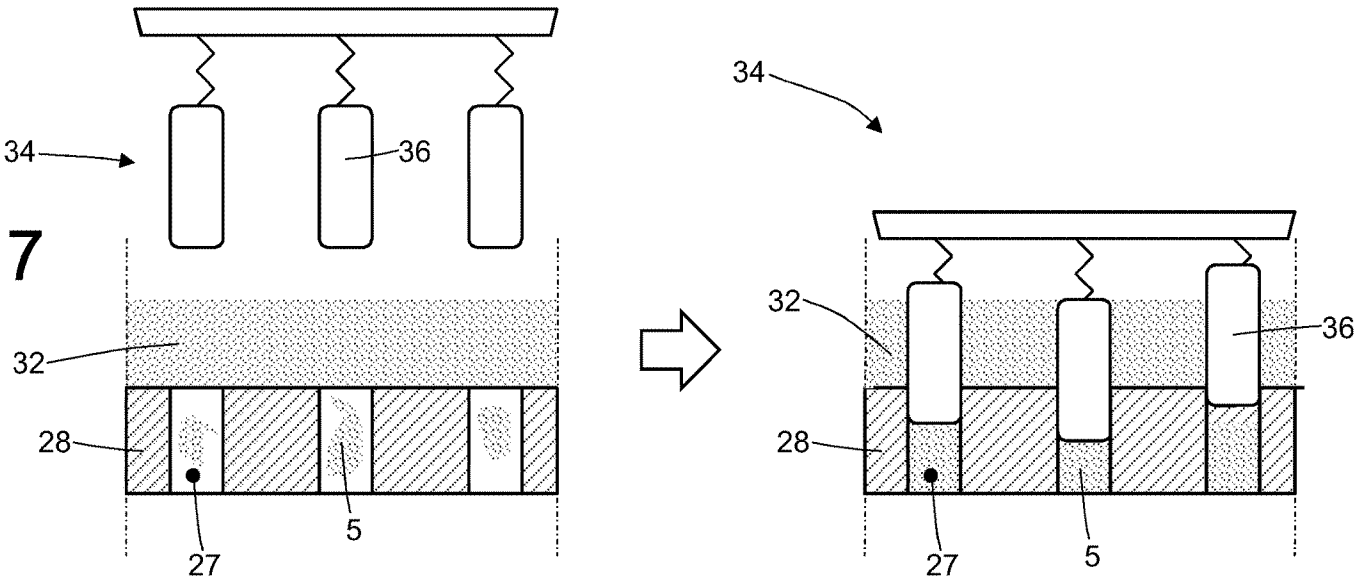
FIGS. 7 and 8 are schematic views of the operation of an alternative of the two compression devices of FIGS. 5 and 6.
Figure 8:
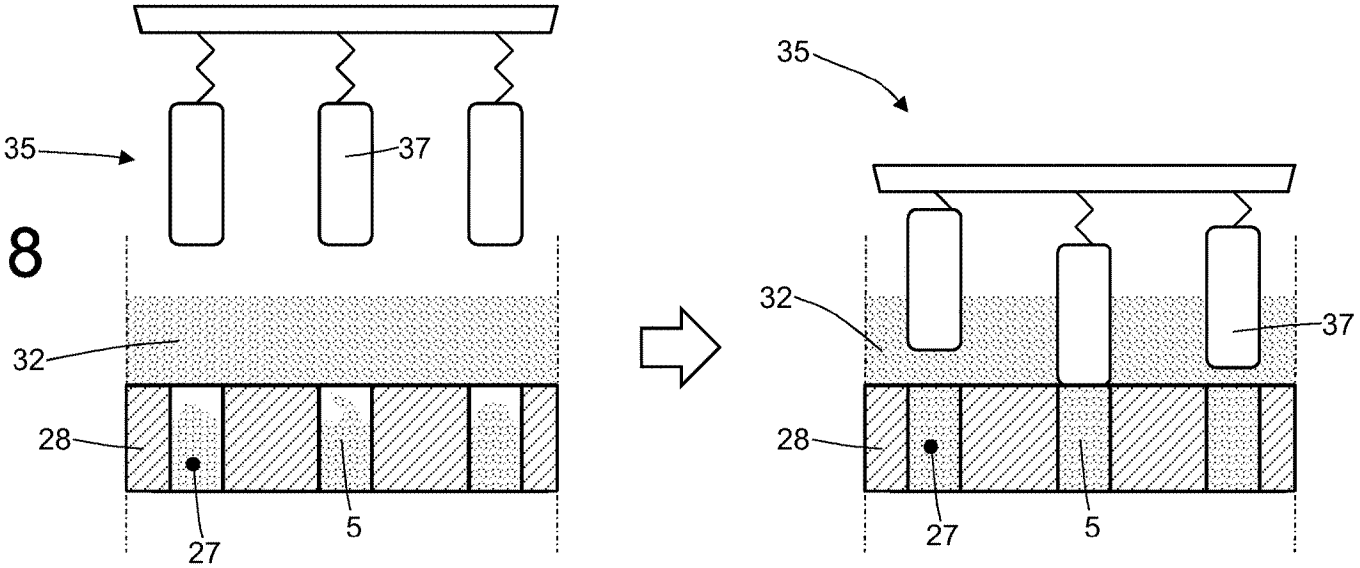

In the embodiment illustrated in FIGS. 5 and 6, the pushers 36 and 37 of the compression devices 34 and 35 are rigidly connected to corresponding actuators which impress the same constant strokes to the pushers 36 and 37 whereas, in the embodiment illustrated in FIGS. 7 and 8, the pushers 36 and 37 of the compression devices 34 and 35 are connected to the corresponding actuators which impart the movement to the pushers 36 and 37 by means of the interposition of elastic elements (for example mechanical or pneumatic springs) which maintain the compression force exerted by the pushers 36 and 37 substantially constant.

Generally, the embodiment illustrated in FIGS. 7 and 8 is preferable, since normally (but not always) it allows to obtain more uniform doses 5 of tobacco, i.e. of a more constant volume and weight.

Figure 9:
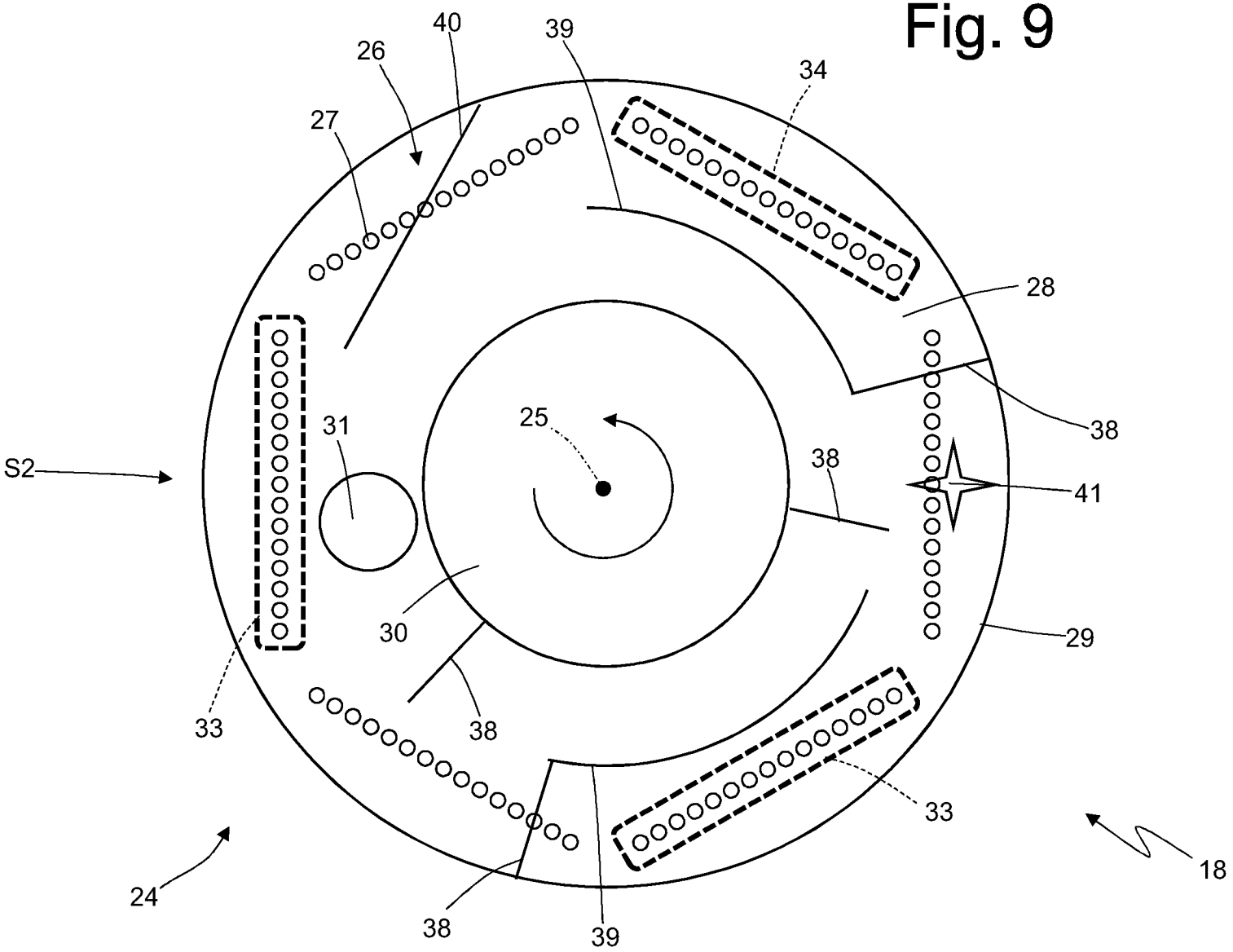
FIG. 9 is a schematic and plan view of the tobacco feeding unit of FIG. 3 showing the movement of the tobacco mass during operation.

As illustrated in FIG. 9, the filling unit 18 comprises a series of walls 38 and 39 which are arranged inside the tank 24 in a fixed position (i.e. without rotating together with the tank 24) and which interfere with the tobacco 32 present inside the tank 24 so as to define preferential and/or forced passage paths for the tobacco 32. In particular, flat walls 38 are provided, which are arranged transversely relative to the rotation of the tank 24 around the rotation axis 25 and cylindrical walls 39 (i.e. formed by a segment of a cylinder with a limited angular width) which are arranged coaxial to the rotation axis 25 and are therefore parallel to the rotation of the tank 24 around the rotation axis 25; the flat walls 38 may or may not be connected to corresponding cylindrical walls 39, i.e. a flat wall 38 can be separated (spaced) from the cylindrical walls 39 or can be connected to a corresponding cylindrical wall 39.

It is important to note that some walls 38 and 39 can be spaced apart from the base disc 28 of the tank 24 so that the tobacco 32 can pass also under the walls 38 and 39, whereas other walls 38 and 39 can be substantially in contact (i.e. with a minimum spacing so as to prevent scraping) against the base disc 28 so that the tobacco 32 cannot pass under the walls 38 and 39. According to a preferred, but not limiting embodiment, all the walls 38 and 39 are (slightly) spaced apart from the base disc 28 of the tank 24 so that the tobacco 32 can pass also under the walls 38 and 39; the distance of the walls 38 and 39 from the base disc 28 of the tank 24 is generally variable, i.e. it is not the same for all the walls 38 and 39 but varies from wall 38 or 39 to wall 38 or 39.

As previously stated, the walls 38 and 39 interfere with the tobacco 32 present inside the tank 24 so as to define preferential and/or forced passage paths for the tobacco 32. The function of the walls 38 and 39 is to force the tobacco 32 to continuously move inside the tank 24 (in FIG. 9 grey arrows denote the movement paths of the tobacco 32) so as to continuously mix and therefore facilitate the correct filling of the seats 27; i.e. the continuous mixing of the tobacco 32 favours the breaking of the bridges that are created between the fibres and which prevent the tobacco 32 from entering into the seats 27.

As illustrated in FIG. 9, the filling unit 18 comprises a scraper element 40, which is arranged inside the tank 24 in a fixed position (i.e. without rotating together with the tank 24) immediately upstream of the transfer device 33 (i.e. the filling station S2) and fulfils the function of pushing away the tobacco 32 which rests against the base disc 28 outside the seats 27 (i.e. not contained in the seats 27). In other words, the scraper element 40 is arranged substantially in contact (i.e. with a minimum spacing to prevent scraping) against the base disc 28 so that the tobacco 32 cannot pass under said scraper element 40; consequently, the scraper element 40 pushes away the tobacco 32 that rests on the base disc 28 outside the seats 27 (i.e. that is not contained in the seats 27) immediately upstream of the transfer device 33 (i.e. of the filling station S2).

Finally, as illustrated in FIG. 9, the filling unit 18 comprises a mixer device 41, which is arranged inside the tank 24 in a fixed position (i.e. without rotating together with the tank 24) at a given distance from the base disc 28 of the tank 24. The mixer device 41 is active, i.e. it comprises moving parts that cyclically move in a completely independent manner from the rotation of the tank 24 around the rotation axis 25. For example, the mixer device 41 could comprise a series of blades which are set in rotation around a vertical rotation axis parallel to the rotation axis 25 of the tank 24. The function of the mixer device 41 is to force the tobacco 32 to continuously move inside the tank 24 in order to continuously mix and thus facilitate the correct filling of the seats 27; i.e. the continuous mixing of the tobacco 32 favours the breaking of the bridges that are created between the fibres and which prevent the tobacco 32 from entering the seats 27.

Figure 10:
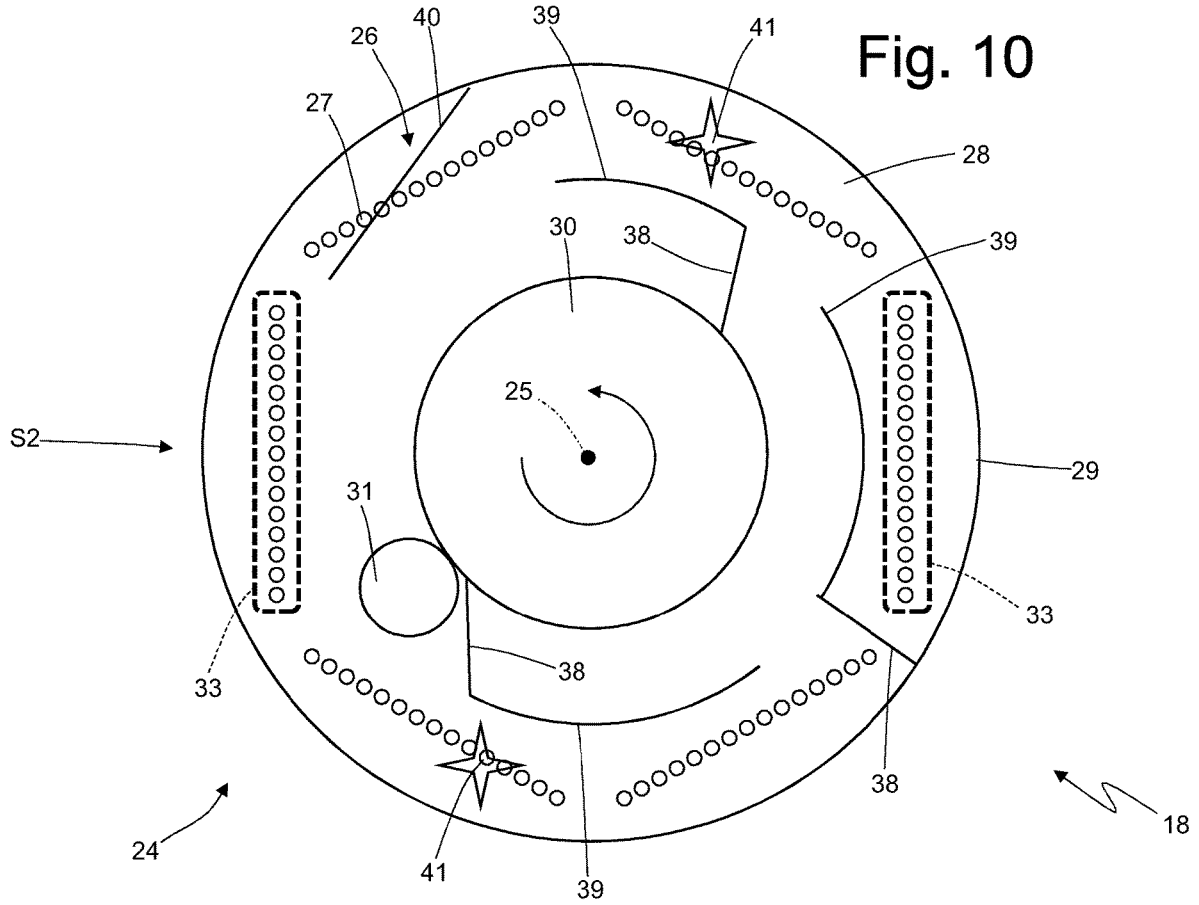
FIGS. 10 and 11 are two schematic and plan views of respective alternatives of the tobacco feeding unit of FIG. 3.
Figure 11:
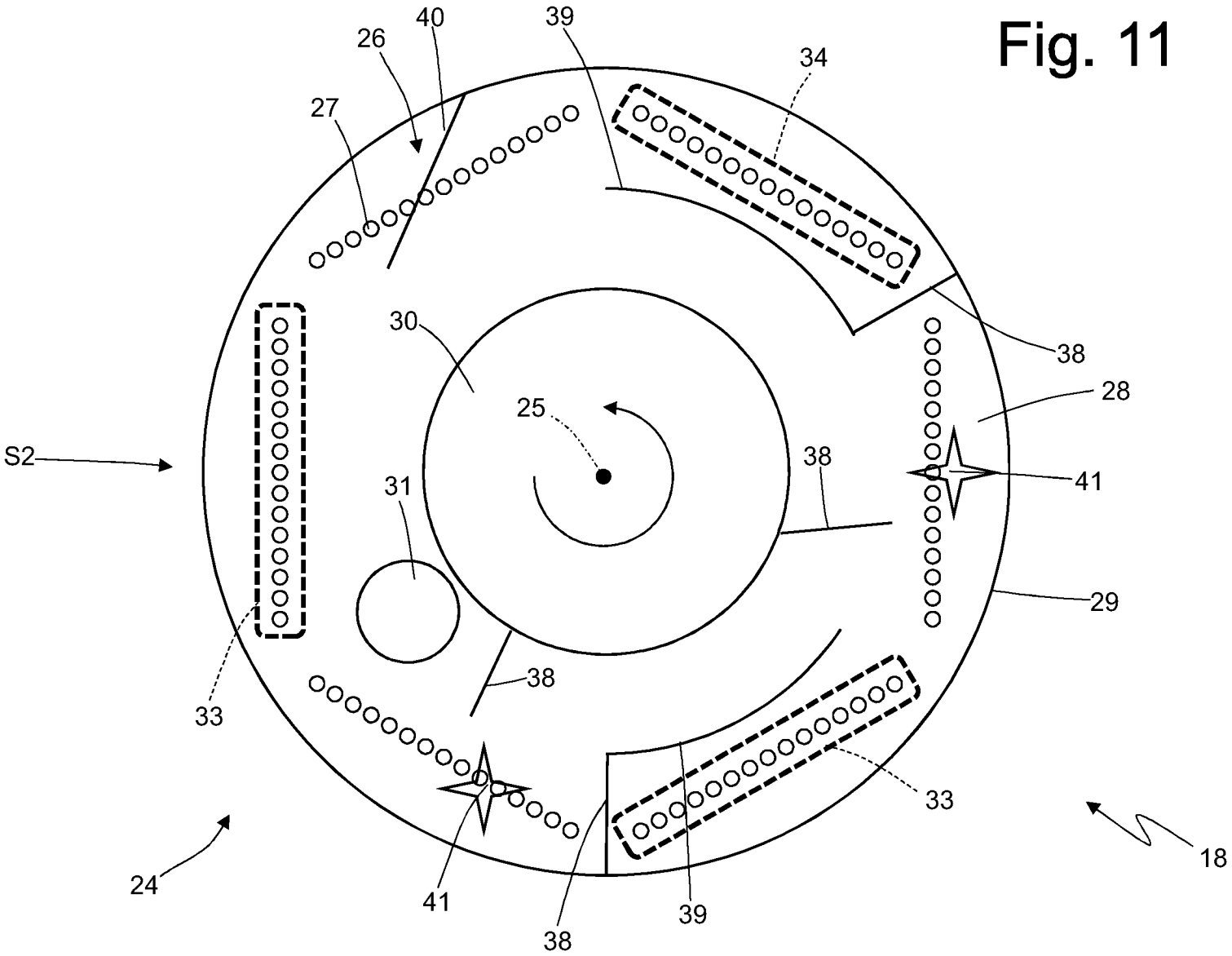

FIGS. 10 and 11 illustrate two alternatives of the filling unit 18 which differ from the filling unit 18 illustrated in FIG. 9 in number and arrangement of the compression devices 33 and 34, the walls 38 and 39, and the mixer device 41. In the alternative illustrated in FIG. 10, only the compression device 33 is provided (i.e. the compression device 34 is absent), two mixer devices 41 are arranged respectively upstream and downstream of the compression device 33, and the position and the conformation of the walls 38 and 39 are different. In the alternative illustrated in FIG. 11, both compression devices 33 and 34 are provided, two mixer devices 41 are provided arranged respectively upstream and downstream of the compression device 33, and the position and the conformation of the walls 38 and 39 are different.

The embodiments described herein can be combined with each other without departing from the scope of protection of the present invention.

The filling unit 18 described above has numerous advantages.

Firstly, the filling unit 18 described above allows to achieve high hourly productivity while ensuring a high quality standard (i.e. by ensuring that in the filling station S2, in each seat 27, a dose of tobacco of constant mass and equal to desired value is provided); experimental tests have shown that the error on the weight of the 5 dose of tobacco can be less than 5-7% even when operating continuously at the nominal speed (i.e. at the maximum speed).

Moreover, the filling unit 18 described above is able to operate with different types of tobacco 32 and, above all, with different degrees of humidity of the tobacco 32 (i.e. from dry tobacco to wet tobacco); it is important to observe that dry tobacco 32 behaves like powder (i.e. as sand), whereas wet tobacco 32 behaves almost like a compact mass, therefore by varying the humidity of the tobacco 32 greatly varies the behaviour of the tobacco 32 itself. In particular, it is possible (and above all it is simple and fast) to adapt the filling unit 18 described above to the type of tobacco to be treated by varying the number and position of the walls 38 and 39, the mixer devices 41 and the compression devices 34 and 35.

The invention claimed is:

1. A filling unit (18) for a manufacturing machine (8) for the production of disposable cartridges (1) for electronic cigarettes; the filling unit (18) comprises:

- a cylindrical-shaped tank (24), which is arranged horizontally, is mounted so as to rotate in a stepwise manner around a vertical rotation axis (25), is delimited, at the bottom, by a base disc (28) having a circular shape, and is delimited, on the sides, by a cylindrical side wall (29), which projects from the base disc (28) in a perpendicular manner;
- a feeding duct (31), which has an outlet opening arranged inside the tank (24) so as to feed a flow of tobacco (32) inside the tank (24), which forms a bed resting on the base disc (28) of the tank (24);
- a plurality of groups (26) of seats (27), each of which is obtained in the base disc (28) and is adapted to receive and hold a corresponding dose (5) of tobacco;
- a transfer device (33), which is arranged in a fixed position at a filling station (S2) and cyclically transfers the doses (5) of tobacco contained inside the seats (27) of a group (26) standing still in the filling station (S2);
- walls (38, 39) which are arranged inside the tank (24) in a fixed position, without rotating together with the tank (24), and which interfere with the tobacco (32) present inside the tank (24) so as to define preferential or forced passage paths for the tobacco (32); and
- at least one mixer device (41), which is arranged inside the tank (24) in a position eccentric with respect to the rotation axis (25) and fixed such that the at least one mixer device does not rotate together with the tank (24), and comprises moving parts, which move cyclically and completely regardless of the rotation of the tank (24) around the rotation axis (25).

2. The filling unit (18) according to claim 1, wherein the mixer device (41) comprises a series of blades which are caused to rotate around a vertical rotation axis, which is parallel to the rotation axis (25) of the tank (24).

3. The filling unit (18) according to claim 1 and comprising two mixer devices (41) arranged at a given distance from one another.

* * * * *